US009488415B2

(12) United States Patent
Takahashi

(10) Patent No.: US 9,488,415 B2
(45) Date of Patent: Nov. 8, 2016

(54) METAL MELTING FURNACE VORTEX CHAMBER BODY AND METAL MELTING FURNACE USING THE SAME

(71) Applicant: Kenzo Takahashi, Matsudo (JP)

(72) Inventor: Kenzo Takahashi, Matsudo (JP)

( * ) Notice: Subject to any disclaimer, the term of this patent is extended or adjusted under 35 U.S.C. 154(b) by 75 days.

(21) Appl. No.: 14/234,861

(22) PCT Filed: May 31, 2013

(86) PCT No.: PCT/JP2013/065154

§ 371 (c)(1),
(2) Date: Jan. 24, 2014

(87) PCT Pub. No.: WO2014/050212

PCT Pub. Date: Apr. 3, 2014

(65) Prior Publication Data

US 2014/0284854 A1 Sep. 25, 2014

(30) Foreign Application Priority Data

Sep. 27, 2012 (JP) ..... 2012-213683

(51) Int. Cl.
*F27D 27/00* (2010.01)

(52) U.S. Cl.
CPC ..... *F27D 27/00* (2013.01)

(58) Field of Classification Search
CPC ..... F27D 27/00
USPC ..... 266/234, 233
See application file for complete search history.

(56) References Cited

U.S. PATENT DOCUMENTS 4,685,657 A * 8/1987 Okubo ..... C22B 9/02 266/234
8,043,403 B2 * 10/2011 Rydholm ..... C22B 7/003 266/234

(Continued)

FOREIGN PATENT DOCUMENTS

CN 101837433 A 9/2010
CN 102213552 A 10/2011

(Continued)

OTHER PUBLICATIONS

International Search Report issued Aug. 6, 2013, in PCT/JP2013/065154, filed May 31, 2013 (with English Translation of Category of Cited Documents).

(Continued)

*Primary Examiner* — Scott Kastler
(74) *Attorney, Agent, or Firm* — Oblon, McClelland, Maier & Neustadt, L.L.P.

(57) ABSTRACT

A metal melting furnace includes: a furnace body including a storage space storing molten metal; a vortex chamber body including a vortex chamber communicating with the storage space, the vortex chamber body including a partition plate serving as a drop weir uprightly formed inside the vortex chamber, the partition plate disposed at a communication side with respect to the storage space in the vortex chamber so that the longitudinal direction of the partition plate follows the communication direction and divides the communication side to form first and second vortex chamber openings positioned at both sides of the partition plate and communicating with both the storage space and the vortex chamber; and a molten metal whirling gap formed between a front end portion of the partition plate positioned inside of the vortex chamber in the longitudinal direction and an inner wall of the vortex chamber body facing the front end portion.

15 Claims, 7 Drawing Sheets

(56) References Cited

U.S. PATENT DOCUMENTS

| | | | | |
|---|---|---|---|---|
| 8,703,043 | B2 * | 4/2014 | Takahashi | F27B 19/04 222/594 |
| 2013/0320602 | A1 * | 12/2013 | Isidorov | C22B 7/003 266/233 |
| 2014/0210145 | A1 * | 7/2014 | Takahashi | B22D 1/00 266/233 |
| 2014/0284854 | A1 * | 9/2014 | Takahashi | F27D 27/00 266/234 |
| 2015/0283605 | A1 * | 10/2015 | Takahashi | B22D 1/00 266/234 |

FOREIGN PATENT DOCUMENTS

| | | |
|---|---|---|
| JP | 60-194278 | 10/1985 |
| JP | 60-194278 A | 10/1985 |
| JP | 5-156378 | 6/1993 |
| JP | 2003-329367 | 11/2003 |
| JP | 2008-196807 | 8/2008 |
| JP | 2010-7971 | 1/2010 |
| JP | 2010-281474 A | 12/2010 |
| JP | 2013-76537 | 4/2013 |
| KR | 10-2001-0026585 A | 4/2001 |

OTHER PUBLICATIONS

U.S. Appl. No. 14/111,130, filed Oct. 10, 2013, Takahashi.
Extended European Search Report issued on Nov. 18, 2014 in the corresponding European Application No. 13770831.9.
U.S. Appl. No. 14/391,522, filed Oct. 9, 2014, Takahashi.
Office Action issued Nov. 27, 2014 in the corresponding Chinese Patent Application No. 201310452294.7 (with English Translation).
Office Action issued Oct. 19, 2015 in Korean Patent Application No. 10-2013-7034667 (with English language translation).

* cited by examiner

METAL MELTING FURNACE VORTEX CHAMBER BODY AND METAL MELTING FURNACE USING THE SAME

TECHNICAL FIELD

The present invention relates to a metal melting furnace vortex chamber body and a metal melting furnace using the same. For example, the present invention relates to a vortex chamber body which is used in a metal melting furnace for conductors (conductive materials) such as Al, Cu, and Zn, alloy of at least two of Al, Cu, and Zn, or Mg-alloy, and a metal melting furnace using the same.

BACKGROUND ART

Hitherto, there have been known methods of generating a vortex inside a vortex chamber body by disposing an electromagnetic coil on the outer circumference of the vortex chamber body or disposing a permanent magnet type shifting magnetic field generator below the vortex chamber body. The vortex chamber body and a furnace body may be integrated with each other or may be connected to each other by flange joints.

Even in any of these methods, the vortex chamber body and the furnace body are connected to each other by a molten metal inlet and a molten metal outlet bored in a furnace wall of the furnace body. Since molten metal rapidly rotates inside the vortex chamber body and a non-melted material rapidly rotates therein, an inner wall of the vortex chamber body is intensively abraded. For this reason, when the management is not sufficiently performed, a molten metal leakage accident occurs in some cases.

This is because the vortex is generated by a molten metal outer circumferential driving method, hence the vortex chamber wall thickness may not be increased. The molten metal leakage accident directly leads to an accident in which the molten metal of the furnace body leaks. In this case, a large amount of the molten metal comes out of the furnace, so that a very dangerous severe accident occurs.

Therefore, it is considered that the vortex chamber needs to be naturally replaced when the durable years expire. Accordingly, there has been expected a rapid melting furnace vortex chamber capable of safely stopping a work even when the molten metal leakage accident occurs during the operation of the rapid melting furnace.

Further, in such a rapid melting furnace, a furnace body and a vortex chamber body both include an agitating device which agitates molten metal therein, hence the rapid melting furnace increases in size. For this reason, there is a problem involving the installation space.

SUMMARY OF INVENTION

Technical Problem

It is an object of the present invention to provide a metal melting furnace vortex chamber body which is compact, requires a small installation space, and is easily maintained at low cost, and a metal melting furnace using the same.

Solution to Problem

The present invention provides a metal melting furnace vortex chamber body with a vortex chamber communicating with a storage space of a furnace body having the storage space storing molten metal, the metal melting furnace vortex chamber body including:

a partition plate which is provided as a drop weir uprightly formed inside the vortex chamber of the vortex chamber body, wherein the partition plate is disposed at a communication side with respect to the storage space in the vortex chamber so that the longitudinal direction of the partition plate follows the communication direction and divides the communication side so as to form first and second vortex chamber openings positioned at both sides of the partition plate and communicating with both the storage space and the vortex chamber, and wherein a molten metal whirling gap is formed between a front end portion of the partition plate positioned at the inside of the vortex chamber in the longitudinal direction and an inner wall of the vortex chamber body facing the front end portion.

The present invention provides a metal melting furnace including:

a furnace body which includes a storage space storing molten metal; and a vortex chamber body which includes a vortex chamber communicating with the storage space of the furnace body, wherein the vortex chamber body includes a partition plate which serves as a drop weir uprightly formed inside the vortex chamber, wherein the partition plate is disposed at a communication side with respect to the storage space in the vortex chamber so that the longitudinal direction of the partition plate follows the communication direction and divides the communication side so as to form first and second vortex chamber openings positioned at both sides of the partition plate and communicating with both the storage space and the vortex chamber, and wherein a molten metal whirling gap is formed between a front end portion of the partition plate positioned at the inside of the vortex chamber in the longitudinal direction and an inner wall of the vortex chamber body facing the front end portion.

DESCRIPTION OF EMBODIMENT

Referring to FIGS. 1 to 7, a non-ferrous metal melting furnace of an embodiment of the present invention will be described.

The non-ferrous metal melting furnace of the embodiment of the present invention is where arbitrary metal or non-ferrous metal of a conductor (conductive material), for example, Al, Cu, and Zn, alloy of at least two of Al, Cu, and Zn, or Mg-alloy or the like is charged and heated with a burner or the like so as to be melted.

Figure 1:
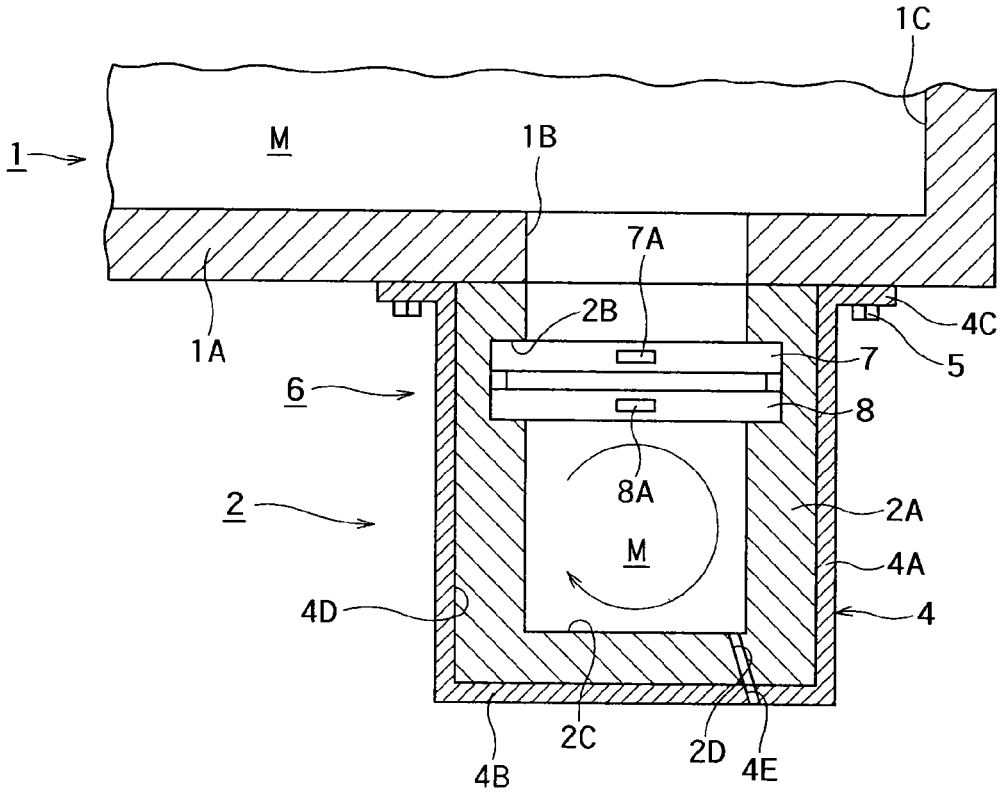
FIG. 1 is a partially cutaway plan view of a non-ferrous metal melting furnace of an embodiment of the present invention.

In this embodiment, as understood particularly from FIG. 1, a furnace body 1 and a vortex chamber body 2 are formed as separate members, and these members are mechanically coupled to each other by an attachment tool 5 so as to communicate with each other through an opening 1B bored in a side wall 1A of the furnace body 1.

The furnace body 1 has, for example, a capacity of several tons to several tens of tons and heats and melts an ingot or the like of non-ferrous metal or the like with a burner so as to make a molten metal M of the non-ferrous metal or the like. The furnace body 1 includes a storage space 1C which stores the molten metal M.

The vortex chamber body 2 has, for example, a capacity capable of storing several hundreds of kilograms of the molten metal M, and is generally used to melt non-ferrous metal as a raw material which is light like aluminum chips or the like to float on the surface of the molten metal M and is not easily melted. In the vortex chamber body 2, the molten metal M is rapidly rotated as a vortex while being heated with a burner or the like inside the furnace body so that the temperature of the molten metal increases, and chips or the like of the non-ferrous metal as a raw material are attracted into the vortex so as to be melted. The vortex chamber body 2 includes a vortex chamber 2C which stores the molten metal M.

The vortex chamber body 2 is formed as a channel shape of which one end is formed as a released end and the other end is formed as a blocked end, and the released end communicates with the storage space 1C.

The furnace body 1 and the vortex chamber body 2 communicate with each other, and the molten metal M of the non-ferrous metal circulates therebetween so that the liquid surface levels thereof match each other.

The attachment tool 5 may be of any type as long as the vortex chamber body 2 may be stably attached to the furnace body 1. In the embodiment, as understood particularly from FIGS. 7(*a*), 7(*b*), and 7(*c*), the attachment tool is formed as a channel shape of which one end is formed as a released end and the other end is formed as a blocked end as the vortex chamber body 2. More specifically, an attachment tool 4 includes a so-called channel-shaped attachment tool body 4A, a blocking plate 4B which blocks the channel, and a flange 4C which folds back the attachment tool body 4A outward at the released side, and a vortex chamber body support space 4D is formed by these members. Further, the attachment tool body 4A is provided with an opening 4E as understood particularly from FIG. 1.

Further, the released end side becomes the flange 4C which is used for the attachment to the furnace body 1. That is, the attachment tool 4 includes the vortex chamber body support space 4D which inevitably has a so-called channel shape. When the vortex chamber body 2 is stored in the vortex chamber body support space 4D of the attachment tool 4 and the flange 4A is fastened to the furnace body 1 with bolts 5, 5 . . . in this state, the vortex chamber body 2 is fixed to the furnace body 1. In this state, as described above, the vortex chamber 2C of the vortex chamber body 2 communicates with the storage space 1C of the furnace body 1 through the opening 1B as understood particularly from FIG. 1.

In addition, the vortex chamber body 2 includes a drain tap 2D which is used to drain the molten metal M in a case of, for example, emergency as understood particularly from FIG. 1. The opening 4E which communicates with the drain tap 2D is bored in the attachment tool 4.

Further, the vortex chamber body 2 is provided with a drop weir part 6. The drop weir part 6 includes a blind drop weir 7 and an opening type drop weir 8 as two weir plates, and these drop weirs are inserted into a vertical groove 2B formed inside a side wall 2A of the vortex chamber body 2 so as to be individually movable up and down. That is, the blind drop weir 7 is disposed at the side of the furnace body 1, and the opening type drop weir 8 is disposed at the opposite side to the furnace body 1.

These weirs 7 and 8 are assembled so that they may not only move up and down but also be completely taken out of the vortex chamber body 2. In this way, the weirs 7 and 8 may be separated from the vortex chamber body 2, so that the maintenance of the furnace body 1 and the vortex chamber body 2 may be performed in an extremely easy way. That is, it is hard to avoid a state where so-called sludges such as oxides are inevitably accumulated with the operation in the furnace body 1 and the vortex chamber body 2. However, since both the weirs 7 and 8 may be separated, there is an advantage that the weirs may be easily cleaned.

Figure 5:
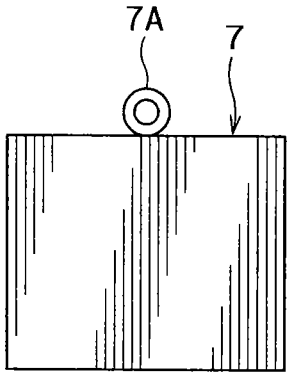
FIG. 5 is a front view illustrating a blind drop weir of the drop weir part of the non-ferrous metal melting furnace of FIG. 1.
Figure 6:
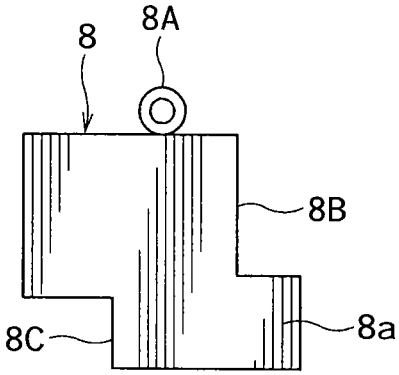
FIG. 6 is a front view illustrating an opening type drop weir of the drop weir part of the non-ferrous metal melting furnace of FIG. 1.
Figure 7:
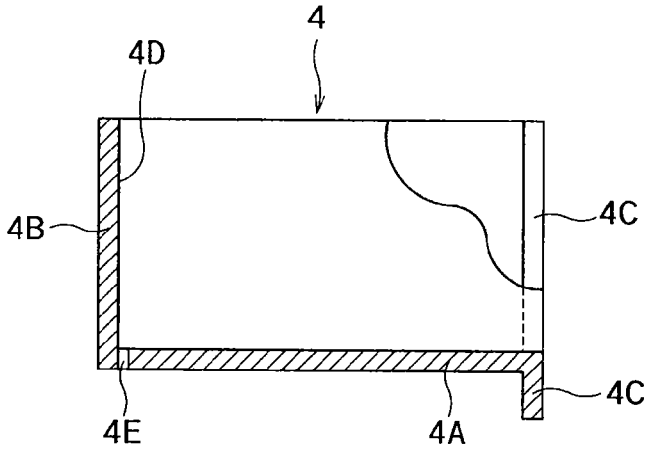
FIG. 7(*a*) is a partially cutaway side view of an attachment tool, 7(*b*) is a partially cutaway front view thereof, and 7(*c*) is a partially cutaway rear view thereof.
Figure 7:
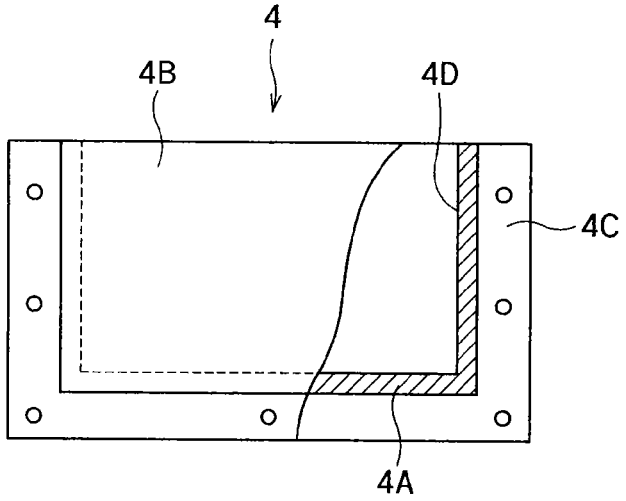
Figure 7:
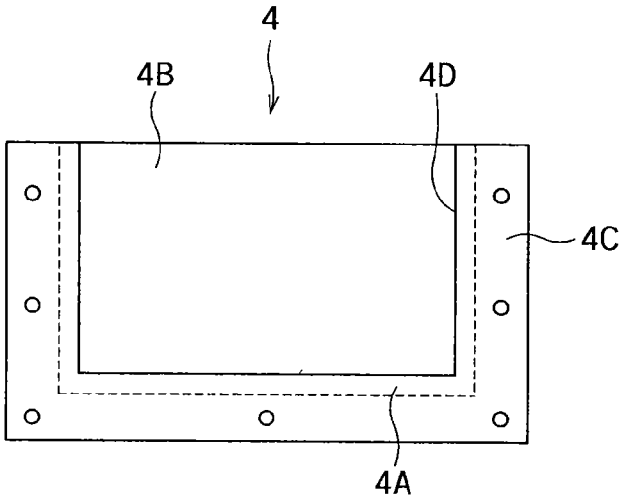

The blind drop weir 7 and the opening type drop weir 8 are respectively illustrated in FIGS. 5 and 6.

As shown in FIG. 5, the blind drop weir 7 is formed as a single plate shape, and a handle 7A is attached to the top portion thereof. As shown in FIG. 6, the opening type drop weir 8 includes an inlet opening 8B and an outlet opening 8C as notches formed at the left and right sides of the lower portion of one plate. That is, the outlet opening 8C and the inlet opening 8B are formed with a predetermined distance therebetween at the lower end side of a plate-like weir body 8*a* of the opening type drop weir 8. A handle 8A is provided.

Figure 3:
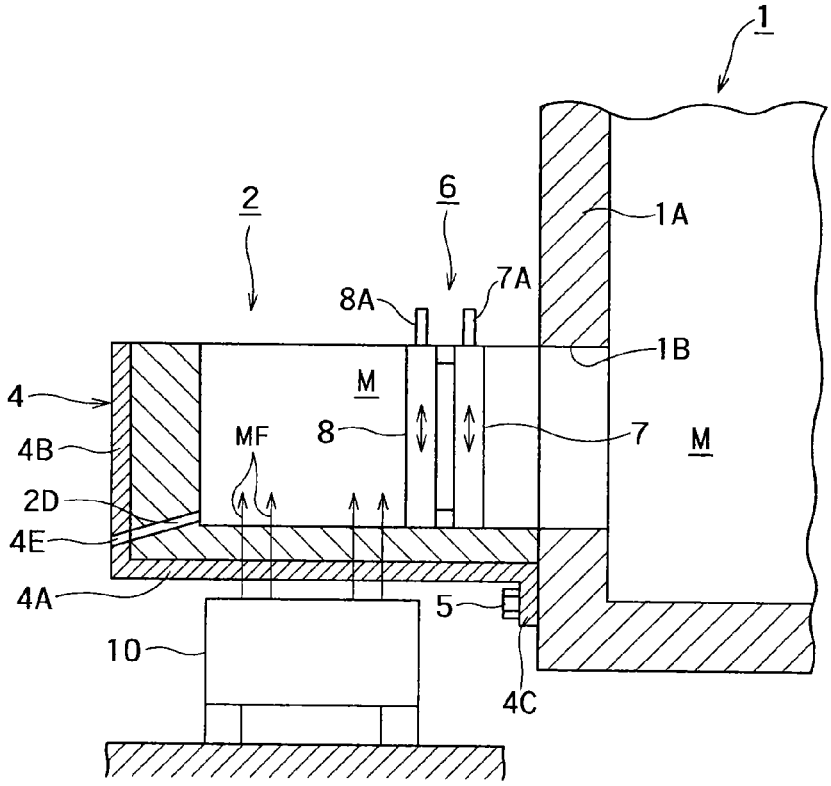
FIG. 3 is a partially cutaway right side view of the non-ferrous metal melting furnace of FIG. 1.
Figure 4:
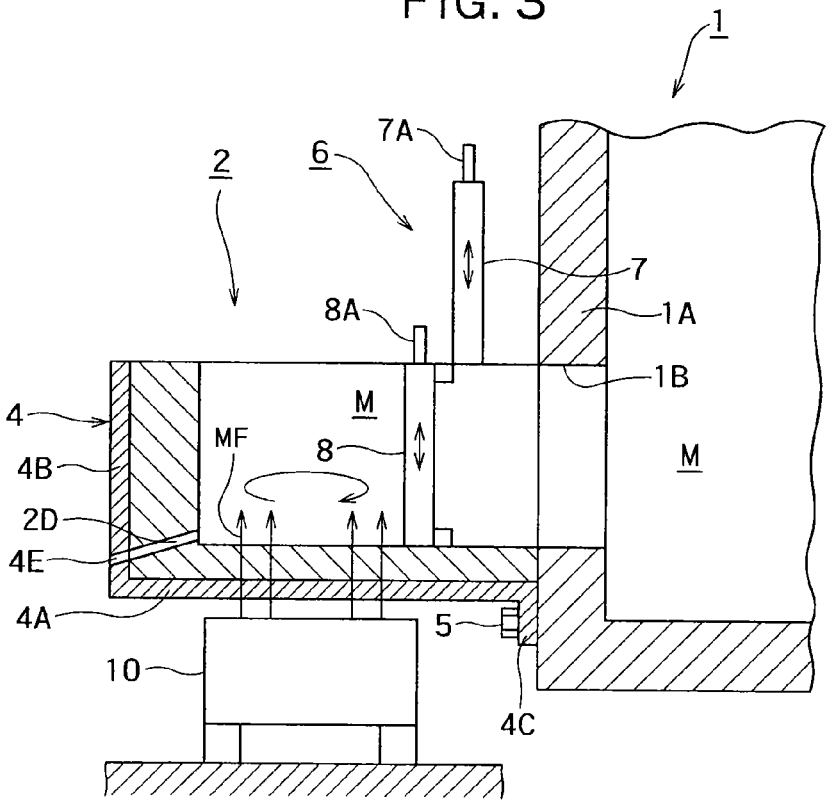
FIG. 4 is a partially cutaway side view for explaining an operation of a drop weir part of the non-ferrous metal melting furnace of FIG. 1.

As understood particularly from FIG. 3, the blind drop weir 7 and the opening type drop weir 8 are adapted to independently slide up and down and to stably take a downward movement position and an upward movement position. For example, the vortex chamber body 2 and the furnace body 1 are interrupted from each other in the state of FIG. 3, and the vortex chamber body 2 and the furnace body 1 communicate with each other through the inlet opening 8B and the outlet opening 8C in the state of FIG. 4.

As a mechanism of driving the two drop weirs, that is, the blind drop weir 7 and the opening type drop weir 8, in the up and down direction, various types such as a chain type, a screw type, a manual type and an electric type may be supposed. However, since the weirs 7 and 8 are extremely light in weight, a driving mechanism of any type is very simple. Here, a specific description thereof will be omitted. Further, the blind drop weir 7 and the opening type drop weir 8 may be formed of any material such as a fire-resisting material which has corrosion resistance with respect to the non-ferrous metal or the like and has a high thermal conductivity. A cheap fire-resisting material which is sold in the market is enough.

Figure 2:
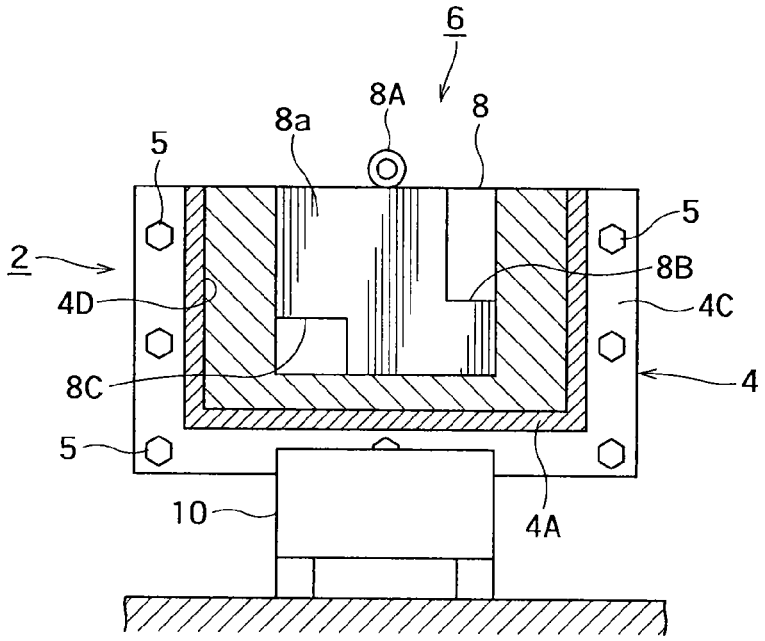
FIG. 2 is a partially cutaway front view of the non-ferrous metal melting furnace of FIG. 1.
Figure 8:
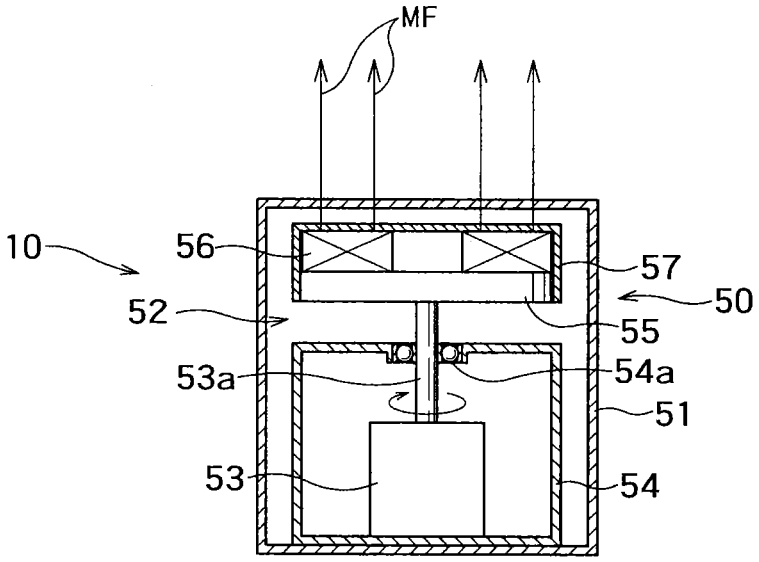
FIG. 8(*a*) is a longitudinal sectional view illustrating a shifting magnetic field generator and FIG. 8(*b*) is a diagram illustrating the arrangement of magnets.
Figure 8:
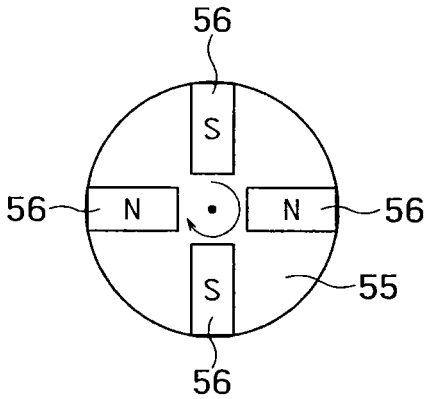

As understood particularly from FIG. 2, a permanent magnet type shifting magnetic field generator 10 is provided at the lower position outside the vortex chamber body 2. The shifting magnetic field generator 10 may be of an electromagnetic type. For example, the shifting magnetic field generator 10 shown in FIGS. 8(*a*) and 8(*b*) may be used. In FIGS. 8(*a*) and 8(*b*), a configuration may be employed in which a rotation magnet body 52 is provided inside a non-magnetic casing 51. In the rotation magnet body 52, a motor 53 is provided inside the casing 54, a shaft 53*a* of the motor 53 is supported by a bearing 54*a*, and a disk-like magnet base 55 is rotatable by the motor 53. A plurality of permanent magnets 56, 56 . . . are fixed onto the magnet base 55 at the interval of 90°. The upper and lower surfaces of the permanent magnets 56, 56 . . . are formed as magnetic poles. Furthermore, as understood from FIG. 8B, the adjacent permanent magnets 56, 56 . . . are magnetized so as to have different polarities. The permanent magnets 56, 56 . . . are covered by a non-magnetic cover 57.

With the above-described configuration, as shown in FIG. 3, a magnetic flux (magnetic lines of force) MF from the permanent magnets 56, 56 . . . penetrates the molten metal M inside the vortex chamber 6, or the magnetic flux MF penetrating the molten metal M enters the permanent magnets 56, 56 . . . . Since the permanent magnets 56, 56 . . . rotate in this state, the magnetic flux MF also moves inside the molten metal M, so that the molten metal M also rotates by the electromagnetic force.

By the rotational driving of the shifting magnetic field generator 10, the molten metal M inside the vortex chamber body 2 whirls by an eddy current and starts to rotate at a high speed, for example, 200 to 300 rpm. The molten metal M which rotates at a high speed is pressed in the outer circumferential direction inside the vortex chamber body 2 by the centrifugal force thereof. The force is strong at the lower side of the vortex chamber body 2. As a result, the molten metal is discharged from the outlet opening 8C of the opening type drop weir 8, and enters the furnace body 1. Further, the molten metal M inside the furnace body 1 returns from the inlet opening 8B to the vortex chamber body 2. When non-ferrous metal chips or the like are input into the vortex of the vortex chamber body 2, the chips or the like are attracted into the vortex, and hence may be rapidly melted.

In addition, the furnace body 1 includes, for example, a shifting magnetic field generator different from that of the vortex chamber body 2, and hence rotates the molten metal M at, for example, 20 to 30 rpm. Further, the molten metal M as a product may be derived from the furnace body 1 to the outside.

Next, a running operation of the above-described metal melting furnace will be described.

Before starting the operation of melting the molten metal M by the vortex chamber body 2, the molten metal M inside the furnace body 1 and the molten metal M inside the vortex chamber body 2 have the same liquid surface level. By the shifting magnetic field generator 10, the molten metal M inside the vortex chamber body 2 is rotated right as illustrated in FIG. 1.

In this state, chips or the like of non-ferrous metal as a raw material are input to the vortex chamber body 2. The chips or the like are further rotated while being attracted into the vortex of the molten metal M inside the rapidly rotating vortex chamber body 2 so as to be efficiently melted. The molten metal M which rotates inside the vortex chamber body 2 flows from the outlet opening 8C into the furnace body 1.

Accordingly, the liquid surface level of the molten metal M of the furnace body 1 becomes higher than the liquid surface level of the molten metal M inside the vortex chamber body 2. Thus, the molten metal M inside the furnace body 1 flows into the vortex chamber body 2 through the inlet opening 8B so that the liquid surface levels become equal to each other. That is, a difference in level, that is, a head is normally generated between the level of the molten metal M of the furnace body 1 and the level of the molten metal M of the vortex chamber body 2, so that the molten metal M circulates.

In this way, in the embodiment of the present invention, the molten metal M inside the vortex chamber body 2 is rotationally driven by the shifting magnetic field generator 10, so that chips or the like as an input raw material may be efficiently melted while being attracted into the vortex.

Incidentally, the embodiment of the present invention also has a feature in handling emergency case. That is, in general, the molten metal M rapidly rotates inside the vortex chamber body 2, and further a non-melted material as a raw material also rotates rapidly in this way. For this reason, it is hard to avoid a state where a non-melted raw material collides with the inner wall of the vortex chamber body 2. As a result, the inner wall of the vortex chamber body 2 is noticeably abraded, and hence the wall is thinned eventually. In addition, a stress such as expansion and contraction by heat is repeatedly applied to the inner wall of the vortex chamber body 2. Thus, the thinned inner wall of the vortex chamber body 2 is cracked by the stress, and hence the molten metal M inside the vortex chamber body 2 may leak to the outside. In this case, the molten metal M of the furnace body 1 is also leaks, and this case may cause a severe accident.

Incidentally, such an accident may be prevented according to the device of the embodiment of the present invention. That is, in a case where the vortex chamber body 2 is damaged, the blind drop weir 7 is promptly moved down so as to interrupt the communication between the vortex chamber body 2 and the furnace body 1, and hence an outlet 22 for the large amount of the molten metal M inside the furnace body 1 may be blocked.

Furthermore, after the communication is interrupted by the blind drop weir 7, the molten metal M which remains inside the vortex chamber body 2 may be promptly drained to the outside by the drain tap 2D and the opening 4E of the attachment tool 4. Accordingly, it is possible to prevent a case where the molten metal M remains inside the vortex chamber body 2 and is cooled and solidified inside the vortex chamber body 2. When the molten metal M is solidified inside the vortex chamber body 2, a severe damage is caused in that the vortex chamber body 2 and the furnace body 1 may not be used again, but this problem may be prevented by the embodiment.

Furthermore, the shape of the vortex chamber body 2 is formed as a rectangular shape (box shape) when viewed from the upside in the embodiment, but it is needless to mention that the shape may be a circular shape, a semicircular shape, or an oval shape.

Figure 9:
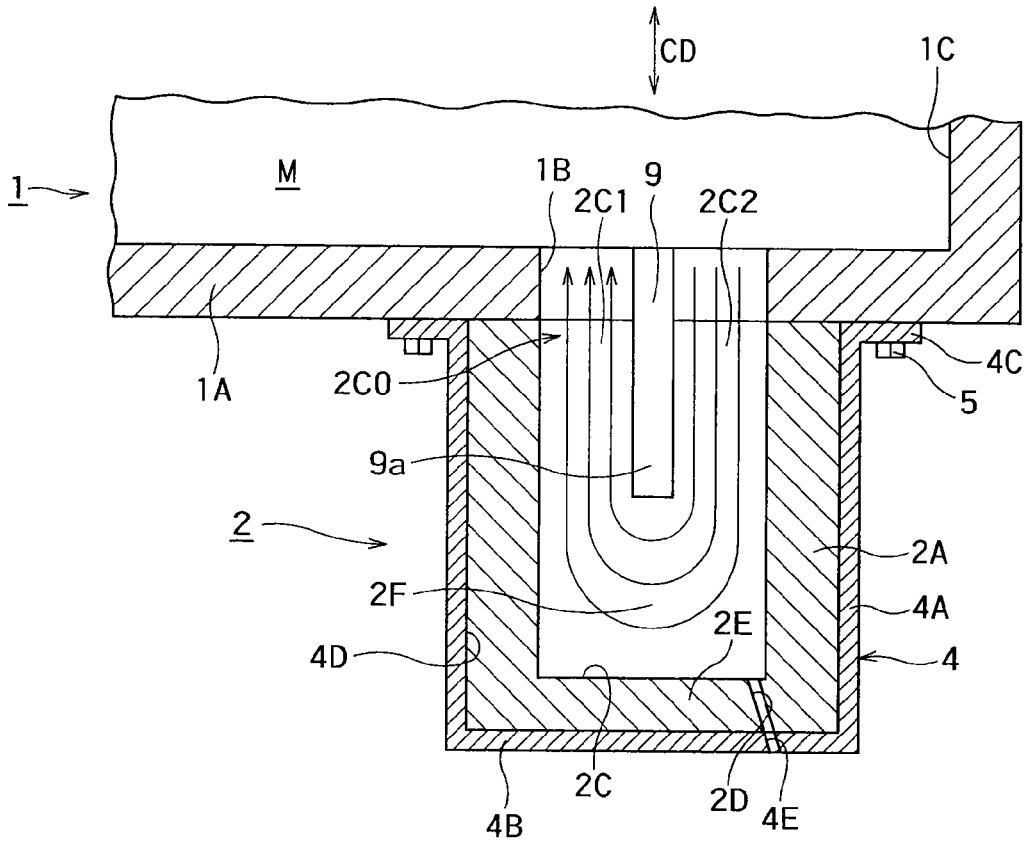
FIG. 9 is a partially cutaway plan view of a non-ferrous metal melting furnace of another embodiment of the present invention.
Figure 10:
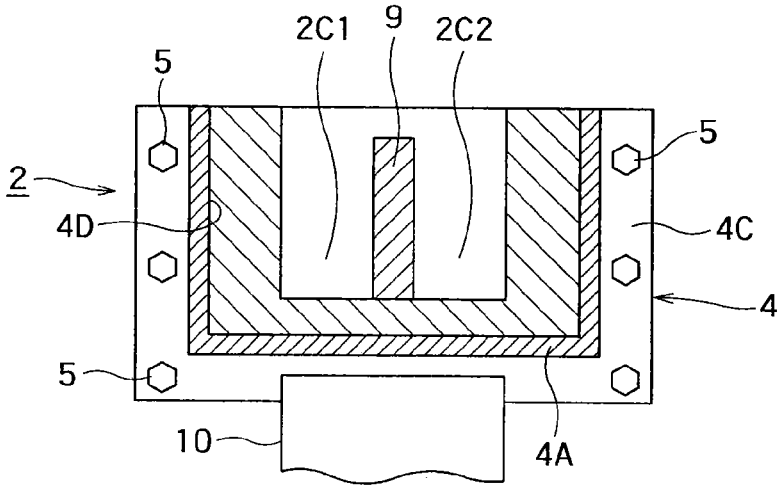
FIG. 10 is a partially cutaway front view of the non-ferrous metal melting furnace of FIG. 9.
Figure 11:
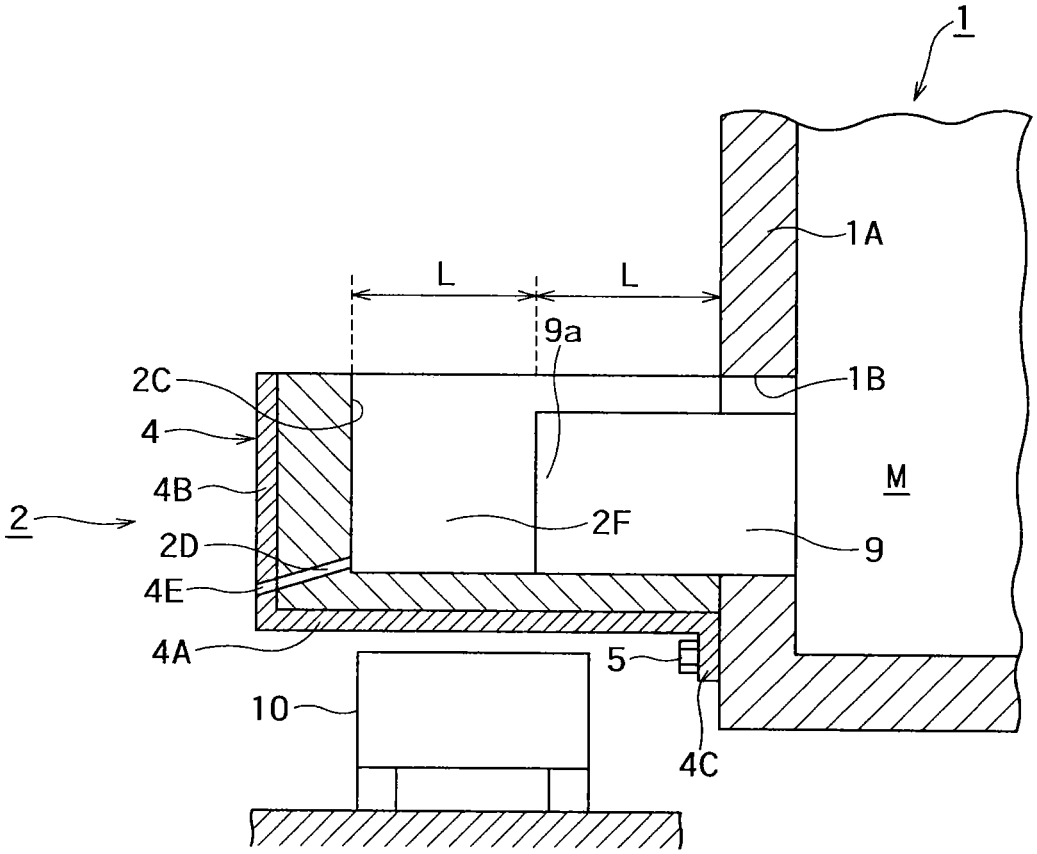
FIG. 11 is a partially cutaway right side view of the non-ferrous metal melting furnace of FIG. 9.

FIG. 9 is a partially cutaway plan view of another embodiment of the present invention, FIG. 10 is a partially cutaway front view thereof, and FIG. 11 is a partially cutaway right side view thereof. In FIGS. 9, 10, and 11, the same reference numerals are given to the same components as those of FIGS. 1, 2, and 3, and the specific description thereof will not be repeated. As understood from the comparison of these drawings with FIGS. 1, 2, and 3, a simple plate without a notch is used as the drop weir (the partition plate) 9. As understood from FIG. 11, the left end of the drop weir 9 in the drawing is positioned at the half of the length 2L of the vortex chamber 2C. Thus, the position of the half serves as the rotation center of the molten metal M.

Hereinafter, this configuration will be described in more detail. A partition plate 9 is provided as a drop weir which is uprightly formed inside the vortex chamber 2C of the vortex chamber body 2. The partition plate 9 is disposed at a communication side 2C0 with respect to the storage space 1C in the vortex chamber 2C so that the longitudinal direction of the partition plate 9 follows the communication direction CD, and divides the communication side 2C0 so as to form a first vortex chamber opening 2C1 and a second vortex chamber opening 2C2 which are positioned at both sides of the partition plate 9, where the first vortex chamber opening 2C1 communicates with both the storage space 1C and the vortex chamber 2C and the second vortex chamber opening 2C2 communicates with both the storage space 1C and the vortex chamber 2C. Then, a molten metal whirling gap 2F is formed between a front end portion 9*a* which follows the longitudinal direction of the partition plate 9 and an inner wall 2E of the vortex chamber body 2 which faces the front end portion 9*a*.

As described above, the front end portion 9*a* which follows the communication direction CD of the partition plate 9 is positioned at the half of the length 2L of the communication direction CD of the vortex chamber 2C.

Further, the partition plate 9 is detachable from the vortex chamber body 2. Accordingly, the maintenance of the partition plate 9 may be performed. Further, the partition plate 9 may be replaced by another partition plate without any damage. Further, various different partition plates may be prepared as the partition plate 9, and may be used in response to the type, the use condition of the molten metal M, or the like.

According to the embodiment, as understood from FIG. 9, the molten metal M is rotationally driven, for example, in the right direction in the drawing by the above-described electromagnetic force. Since the stream of the molten metal M inside the vortex chamber 2C flows into or flows out of the furnace body 1, the molten metal M inside the furnace body 1 is rotationally driven even when the furnace body 1 does not include an individual electromagnetic agitating device. That is, the furnace body 1 does not essentially need the electromagnetic agitating device. Accordingly, a decrease in cost and a simple and compact structure may be realized, so that it is possible to provide a device which requires a small installation space and is very conveniently installed as an actual device.

Further, it is needless to mention that the present invention may be applied to not only the above-described non-ferrous metal melting furnace, but also other metal melting furnaces.

The invention claimed is:

1. A metal melting furnace vortex chamber body with a vortex chamber communicating with a storage space of a furnace body having the storage space storing molten metal, the metal melting furnace vortex chamber body comprising:

a communicating side or a communicating opening formed in a part of a side wall, the vortex chamber of the vortex chamber body and the storage space of the furnace body communicating through the communicating opening, a shape of a cross-section of the side wall of the vortex chamber being substantively U-shaped, the vortex chamber being a space surrounded by the side wall, the vortex chamber having a given first width, a given first length and a given first height, and a partition plate which is made of a flat plate and is uprightly arranged inside the vortex chamber of the vortex chamber body, the partition plate having a given second width, a given second length and a given second height, wherein the partition plate is disposed at a communication side with respect to the storage space in the vortex chamber so that the second length direction of the partition plate follows the first length direction of the vortex chamber, and the partition plate divides the communication side so as to form first and second vortex chamber openings positioned at both sides of the partition plate and communicating with both the storage space and the vortex chamber, the first and the second vortex chamber openings line along the first and the second width directions, wherein a gap is formed between a front end portion of the partition plate positioned at the inside of the vortex chamber in the second length direction and an inner wall of the vortex chamber body facing the front end portion, wherein the first vortex chamber opening and the second vortex chamber opening communicate via the gap, and wherein the partition plate is detachable from the vortex chamber, a communicating opening reappearing by removing the partition plate so that the vortex chamber of the vortex chamber body and the storage space of the furnace body communicate through the communicating opening.

2. The metal melting furnace vortex chamber body according to claim 1, wherein the position of the front end portion of the partition plate in the second length direction is set as the position of a half of the length of the vortex chamber in the first length direction.

3. The metal melting furnace vortex chamber body according to claim 1, wherein a shifting magnetic field generator is disposed at an outer lower side of the vortex chamber body so as to generate a magnetic field to rotationally drive the molten metal inside the vortex chamber body by a permanent magnet.

4. A metal melting furnace comprising:

a furnace body which includes a storage space storing molten metal; and a vortex chamber body which includes a vortex chamber communicating with the storage space of the furnace body, the vortex chamber body comprising:

a communicating side or a communicating opening formed in a part of a side wall, the vortex chamber of the vortex chamber body and the storage space of the furnace body communicating through the communicating opening, the shape of a cross-section of the side wall of the vortex chamber being substantively U-shaped, the vortex chamber being a space surrounded by the side wall, the vortex chamber having a given first width, a given first length and a given first height, and a partition plate which is made of a flat plate and is uprightly arranged inside the vortex chamber of the vortex chamber body, the partition plate having a given second width, a given second length and a given second height, wherein the partition plate is disposed at a communication side with respect to the storage space in the vortex chamber so that the second length direction of the partition plate follows the first length direction of the vortex chamber, and the partition plate divides the communication side so as to form first and second vortex chamber openings positioned at both sides of the partition plate and communicating with both the storage space and the vortex chamber, the first and the second vortex chamber openings line along the first and the second width directions, wherein a gap is formed between a front end portion of the partition plate positioned at the inside of the vortex chamber in the second length direction and an inner wall of the vortex chamber body facing the front end portion, wherein the first vortex chamber opening and the second vortex chamber opening communicate via the gap, and wherein the partition plate is detachable from the vortex chamber, a communicating opening reappearing by removing the partition plate so that the vortex chamber of the vortex chamber body and the storage space of the furnace body communicate through the communicating opening.

5. The metal melting furnace according to claim 4, wherein the position of the front end portion of the partition plate in the second length direction is set as the position of a half of the length of the vortex chamber in the first length direction.

6. The metal melting furnace according to claim 4, wherein the vortex chamber body is provided with a drain tap to drain molten metal therethrough.

7. The metal melting furnace according to claim 4, wherein a shifting magnetic field generator is disposed at an outer lower side of the vortex chamber body so as to generate a magnetic field to rotationally drive the molten metal inside the vortex chamber body by a permanent magnet.

8. A metal melting furnace vortex chamber body with a vortex chamber communicating with a storage space of a furnace body having the storage space storing molten metal, the metal melting furnace vortex chamber body comprising:

a communicating side or a communicating opening formed in a part of a side wall, the vortex chamber of the vortex chamber body and the storage space of the furnace body being communicated through the communicating opening, the shape of the cross-section of the side wall of the vortex chamber being substantively U-shaped, the vortex chamber being a space surrounded by the side wall, the vortex chamber having a given first width, a given first length and a given first height, and a partition plate which is made of a flat plate and is uprightly arranged inside the vortex chamber of the vortex chamber body, the partition plate having a given second width, a given second length and a given second height, wherein the partition plate is disposed at a communication side with respect to the storage space in the vortex chamber so that the second length direction of the partition plate follows the first length direction of the vortex chamber, and the partition plate divides the communication side so as to form first and second vortex chamber openings positioned at both sides of the partition plate and communicating with both the storage space and the vortex chamber, the first and the second vortex chamber openings line along the first and the second width directions, wherein a gap is formed between a front end portion of the partition plate positioned at the inside of the vortex chamber in the second length direction and an inner wall of the vortex chamber body facing the front end portion, wherein the first vortex chamber opening and the second vortex chamber opening communicate via the gap, and wherein the vortex chamber body is provided with a drain tap to drain molten metal therethrough.

9. The metal melting furnace vortex chamber body according to claim 8, wherein the position of the front end portion of the partition plate in the second length direction is set as the position of a half of the length of the vortex chamber in the communication direction.

10. The metal melting furnace vortex chamber body according to claim 8, wherein the partition plate is detachable from the vortex chamber body.

11. The metal melting furnace vortex chamber body according to claim 8, wherein a shifting magnetic field generator is disposed at an outer lower side of the vortex chamber body so as to generate a magnetic field to rotationally drive the molten metal inside the vortex chamber body by a permanent magnet.

12. A metal melting furnace comprising:

a furnace body which includes a storage space storing molten metal; and a vortex chamber body which includes a vortex chamber communicating with the storage space of the furnace body, the vortex chamber body comprising:

a communicating side or a communicating opening formed in a part of a side wall, the vortex chamber of the vortex chamber body and the storage space of the furnace body communicating through the communicating opening, the shape of a cross-section of the side wall of the vortex chamber being substantively U-shaped, the vortex chamber being a space surrounded by the side wall, the vortex chamber having a first given width, a given first length and a given first height, and a partition plate which is made of a flat plate and is uprightly arranged inside the vortex chamber of the vortex chamber body, the partition plate having a given second width, a given second length and a given second height, wherein the partition plate is disposed at a communication side with respect to the storage space in the vortex chamber so that the second length direction of the partition plate follows the first length direction of the vortex chamber, and the partition plate divides the communication side so as to form first and second vortex chamber openings positioned at both sides of the partition plate and communicating with both the storage space and the vortex chamber, the first and the second vortex chamber openings line along the first and the second width directions, wherein a gap is formed between a front end portion of the partition plate positioned at the inside of the vortex chamber in the second length direction and an inner wall of the vortex chamber body facing the front end portion, wherein the first vortex chamber opening and the second vortex chamber opening communicate via the gap, and wherein the vortex chamber body is provided with a drain tap to drain molten metal therethrough.

13. The metal melting furnace according to claim 12, wherein the position of the front end portion of the partition plate in the second length direction is set as the position of a half of the length of the vortex chamber in the first length direction.

14. The metal melting furnace according to claim 12, wherein the partition plate is detachable from the vortex chamber body.

15. The metal melting furnace according to claim 12, wherein a shifting magnetic field generator is disposed at the outer lower side of the vortex chamber body so as to generate a magnetic field to rotationally drive the molten metal inside the vortex chamber body by a permanent magnet.

* * * * *